US011391154B2

(12) United States Patent
Yang

(10) Patent No.: US 11,391,154 B2
(45) Date of Patent: Jul. 19, 2022

(54) SCROLL EXPANDER WITH BACK PRESSURE CHAMBER

(71) Applicant: Emerson Climate Technologies (Suzhou) Co., Ltd., Jiangsu (CN)

(72) Inventor: Donghui Yang, Jiangsu (CN)

(73) Assignee: EMERSON CLIMATE TECHNOLOGIES (SUZHOU) CO., LTD., Jiangsu (CN)

( * ) Notice: Subject to any disclaimer, the term of this patent is extended or adjusted under 35 U.S.C. 154(b) by 0 days.

(21) Appl. No.: 17/296,236

(22) PCT Filed: Nov. 4, 2019

(86) PCT No.: PCT/CN2019/115289
§ 371 (c)(1),
(2) Date: May 22, 2021

(87) PCT Pub. No.: WO2020/103681
PCT Pub. Date: May 28, 2020

(65) Prior Publication Data

US 2022/0018346 A1 Jan. 20, 2022

(30) Foreign Application Priority Data

Nov. 22, 2018 (CN) ..... 201811397574.1
Nov. 22, 2018 (CN) ..... 201821934748.9

(51) Int. Cl.
*F01C 1/02* (2006.01)
*F04C 18/02* (2006.01)
(Continued)

(52) U.S. Cl.
CPC ..... *F01C 1/0215* (2013.01); *F01C 20/06* (2013.01); *F01C 21/005* (2013.01);
(Continued)

(58) Field of Classification Search
CPC ..... F01C 1/0215–0292; F01C 21/006; F04C 18/0215–0292; F04C 2/025
See application file for complete search history.

(56) References Cited

U.S. PATENT DOCUMENTS 6,419,457 B1 7/2002 Seibel et al.
6,679,683 B2 1/2004 Seibel et al.
(Continued)

FOREIGN PATENT DOCUMENTS

CN 1349053 A 5/2002
CN 1702328 A 11/2005
(Continued)

OTHER PUBLICATIONS

International Search Report of the ISA regarding Application No. PCT/CN2019/115289 dated Feb. 1, 2020, in English and Chinese.
(Continued)

*Primary Examiner* — Laert Dounis
(74) *Attorney, Agent, or Firm* — Harness, Dickey & Pierce, P.L.C.

(57) ABSTRACT

A scroll expander, comprising: a housing; and an expansion mechanism provided in the housing. A back pressure chamber in fluid communication with a medium pressure chamber is provided in the expansion mechanism and is provided with at least one passage in fluid communication from the back pressure chamber to a low pressure region; the passage is configured such that: the passage is opened when the pressure in the back pressure chamber is lower than the pressure of the low pressure region, and is closed when the pressure in the back pressure chamber is higher than or equal to the pressure of the low pressure region. The scroll expander can avoid the problem of being unable to be started
(Continued)

and to operate normally; and the scroll expander is simple in structure, easy to process and manufacture, and high in cost effectiveness.

18 Claims, 8 Drawing Sheets

(51) Int. Cl.
*F01C 21/00* (2006.01)
*F01C 20/06* (2006.01)
*F01C 21/18* (2006.01)

(52) U.S. Cl.
CPC ..... *F01C 21/006* (2013.01); *F04C 18/0215* (2013.01); *F01C 21/18* (2013.01)

(56) References Cited

U.S. PATENT DOCUMENTS

| | | | |
|---|---|---|---|
| 7,074,013 | B2 | 7/2006 | Seibel et al. |
| 7,338,265 | B2 | 3/2008 | Grassbaugh et al. |
| 7,568,897 | B2 | 8/2009 | Grassbaugh et al. |
| 7,758,326 | B2 | 7/2010 | Fujimura et al. |
| 8,475,140 | B2 | 7/2013 | Seibel et al. |
| 2003/0012659 | A1 | 1/2003 | Seibel et al. |
| 2004/0081562 | A1 | 4/2004 | Seibel et al. |
| 2006/0198748 | A1 | 9/2006 | Grassbaugh et al. |
| 2006/0204379 | A1 | 9/2006 | Seibel et al. |
| 2006/0204380 | A1 | 9/2006 | Seibel et al. |
| 2007/0231172 | A1 | 10/2007 | Fujimura et al. |
| 2007/0269326 | A1 | 11/2007 | Seibel et al. |
| 2008/0175737 | A1 | 7/2008 | Grassbaugh et al. |

FOREIGN PATENT DOCUMENTS

| | | | | |
|---|---|---|---|---|
| CN | 1828022 | A | | 9/2006 |
| CN | 101046201 | A | | 10/2007 |
| CN | 207847700 | U | * | 9/2018 |
| CN | 209385182 | U | * | 9/2019 |
| DE | 102013021250 | A1 | * | 6/2015 |
| DE | 102017206172 | A1 | * | 10/2018 |
| JP | 2012149532 | A | | 8/2012 |
| JP | 2013104305 | A | | 5/2013 |
| JP | 2014125908 | A | | 7/2014 |
| KR | 20160043407 | A | | 4/2016 |
| WO | WO-2017043471 | A1 | * | 3/2017 |

OTHER PUBLICATIONS

Written Opinion of the ISA (English & Chinese) regarding Application No. PCT/CN2019/115289 dated Jan. 31, 2020.

* cited by examiner

SCROLL EXPANDER WITH BACK PRESSURE CHAMBER

This application is the national phase of International Application No. PCT/CN2019/115289 titled "VORTEX EXPANDER" and filed on Nov. 4, 2019, which claims the benefit of priorities to the following two Chinese patent applications, both of which are incorporated herein by reference: Chinese Patent Application No. 201811397574.1, titled "VORTEX EXPANDER", filed with the China National Intellectual Property Administration on Nov. 22, 2018; and Chinese Patent Application No. 201821934748.9, titled "VORTEX EXPANDER", filed with the China National Intellectual Property Administration on Nov. 22, 2018.

TECHNICAL FIELD

The present disclosure generally relates to the field of expanders, and in particular to a scroll expander.

BACKGROUND

This section provides background information relating to the present disclosure, which may not necessarily constitute the prior art.

An expander is a device that uses a high-pressure fluid for expanding into a low-pressure fluid to output mechanical or electrical work. A common expander is a scroll expander. An expansion mechanism of the scroll expander includes an orbiting scroll and a fixed scroll. The orbiting scroll and the fixed scroll are engaged with each other to define a series of expansion chambers between the orbiting scroll wrap and the static scroll wrap, and the series of expansion chambers gradually increase in volume radially outward from the center of the expansion mechanism. As a result, the high-pressure fluid entering the expansion mechanism from an intake port at the center of the expansion mechanism becomes the low-pressure fluid after passing through the series of expansion chambers and is discharged out of the expansion mechanism through an exhaust port. In the process of fluid expansion, a driving torque is generated, which may for example drive the shaft to rotate to output mechanical or electrical work.

Regardless of whether it is a scroll expander with a floating orbiting scroll or a scroll expander with a floating fixed scroll, in a case that a back pressure chamber is usually unable to provide enough pressure to compress an orbiting scroll and a fixed scroll, it may cause the orbiting scroll and the fixed scroll to separate or an abnormal shaking of the orbiting scroll and the fixed scroll, resulting in the failure to establish a normal pressure difference in the scroll expander or wear between the orbiting scroll and the fixed scroll, thus failing to start and work normally.

Taking a scroll expander with a floating fixed scroll, especially a scroll expander with a floating sealing ring provided on a back side of the end plate of the fixed scroll for sealing the back pressure chamber, for example, the back pressure chamber is composed of a groove and a floating sealing ring provided on the end plate of the fixed scroll, wherein the back pressure chamber is in fluid communication with an intermediate pressure chamber defined in the expansion mechanism, which has an intermediate pressure lower than the intake pressure and higher than the exhaust pressure. By making the back pressure chamber have the same pressure as the intermediate pressure chamber, the orbiting scroll and the fixed scroll are ensured to be engaged, and this engagement is flexible, which may provide a certain flexibility in the axial direction to prevent the orbiting scroll and the fixed scroll from being severely worn under certain conditions (such as foreign particles entering into the expansion mechanism) due to rigid engagement. In addition, the floating sealing ring is pressed to be abut against a corresponding wall (especially, a top end of an upper plate of the floating sealing ring is abut against a bottom surface of a partition plate for example) through the pressure in the back pressure chamber, so that a low-pressure zone (with exhaust pressure), a high-pressure zone (with pressure of the high-pressure fluid) and the intermediate pressure zone (back pressure chamber with the intermediate pressure) in the housing of the scroll expander are isolated from each other by the floating sealing ring, so as to ensure the normal operation of the scroll expander.

As mentioned above, the floating sealing ring needs to rely on sufficient pressure in the intermediate pressure chamber to play a sealing role, so as to ensure a normal start and a normal operation of the scroll expander. However, in a scroll expander in the prior art, before being started, a back pressure chamber usually cannot provide enough pressure to provide enough support for a floating sealing ring. When an input of a high-pressure fluid into a high-pressure zone in the scroll expander begins, the floating sealing ring is collapsed into the back pressure chamber due to unbalanced forces (e.g., an expansion of the intermediate pressure chamber, which causes a pressure drop in the intermediate pressure chamber, and further causes that the pressure in the back pressure chamber drops to a pressure below the pressure in the low-pressure zone, resulting in unbalanced forces), so that a sealing and isolation effect cannot be performed (i.e., causing fluid to flow directly from the high-pressure zone to the low-pressure zone, which causes the expansion mechanism to be bypassed), resulting in the inability to establish a normal pressure difference in the scroll expander, thus failing to start and work normally. Therefore, an improved scroll expander is needed to overcome the above technical problems in the prior art.

SUMMARY

A general summary of the present disclosure is provided in this section, which is not the full scope of the present disclosure or a comprehensive disclosure of all features of the present disclosure.

The purpose of the present disclosure is to solve one or more technical problems mentioned above.

A scroll expander is provided according to an aspect of the present disclosure, including:

a housing; and an expansion mechanism provided inside the housing and configured to expand a high-pressure fluid with an intake pressure to a low-pressure fluid with an exhaust pressure, the expansion mechanism comprising a fixed scroll and an orbiting scroll and defining therein an exhaust chamber, an intake chamber and a series of closed expansion chambers, wherein a back pressure chamber is provided on the expansion mechanism, and the back pressure chamber is in fluid communication with an intermediate pressure chamber of the series of expansion chambers which has an intermediate pressure lower than the intake pressure and higher than the exhaust pressure, wherein at least one passage in fluid communication from the back pressure chamber to a low-pressure zone with the exhaust pressure is provided, and the passage is configured such that the passage is opened when a pressure in the back pressure chamber is less than a pressure in the low-pressure zone and the passage is closed when a pressure in the back pressure chamber is greater than or equal to a pressure in the low-pressure zone.

By providing the passage, in a case that a pressure in the back pressure chamber is less than a pressure in the low-pressure zone, the passage can be opened to make up for the insufficient pressure in the back pressure chamber, and in a case that a pressure in the back pressure chamber is greater than or equal to a pressure in the low-pressure zone, the passage may be closed to maintain the pressure in the back pressure chamber. It can be seen that the above configuration may overcome the technical problem that the scroll expander in the prior art cannot start and work normally.

According to an aspect of the present disclosure, the fixed scroll is capable of floating axially relative to the orbiting scroll.

According to an aspect of the present disclosure, the back pressure chamber is provided at a back side of an end plate of the fixed scroll, and the back pressure chamber is sealed by a floating sealing ring.

According to an aspect of the present disclosure, the low-pressure zone includes a low-pressure area outside the expansion mechanism and the exhaust chamber of the expansion mechanism which is directly communicated with the low-pressure area, and the passage is provided in the end plate of the fixed scroll and is directly communicated with the low-pressure area or directly communicated with the exhaust chamber.

According to an aspect of the present disclosure, a check valve capable of closing and opening the passage is provided at the passage such that the passage is opened when a pressure in the back pressure chamber is less than a pressure in the low-pressure zone, and the passage is closed when a pressure in the back pressure chamber is greater than or equal to a pressure in the low-pressure zone.

According to an aspect of the present disclosure, the passage includes an orifice that opens into the back pressure chamber, and the check valve is provided at the orifice to close or open the orifice.

According to an aspect of the present disclosure, the check valve includes a valve plate and a valve stopper provided at the orifice, and the valve plate is provided as an elastically deformable valve plate fixed at one end or as an integrally movable valve plate, and the valve stopper is provided so that the valve plate is placed between the orifice and the valve stopper.

According to an aspect of the present disclosure, the check valve includes a cover provided at the orifice, and in a case that a pressure in the back pressure chamber is less than a pressure in the low-pressure zone, the cover causes the orifice to be opened, and in a case that a pressure in the back pressure chamber is greater than or equal to a pressure in the low-pressure zone, the cover abuts against the orifice to close it.

According to an aspect of the present disclosure, the cover is an elastically deformable long valve plate fixed at one end, and the check valve further includes a valve stopper. The valve stopper is configured to place the valve plate between the orifice and the valve stopper, and a side surface of the valve stopper, which faces the valve plate, is formed as an arc surface.

The elastically deformable long valve plate is not only simple in structure, but also has good resilience, is durable, and may accurately and timely close the orifice, and has high sensitivity. Preferably, by providing the above valve stopper, a degree of deformation of the long valve plate (a distance away from the orifice) may be effectively controlled, so as to prevent the long valve plate from being excessively deformed due to accidental large force and unable to close the orifice in time. Therefore, the sensitivity of the check valve may be further improved.

According to an aspect of the present disclosure, the cover is an integrally movable valve plate, and the check valve further includes a valve stopper, and the valve stopper is configured to place the cover between the orifice and the valve stopper. A predetermined space is provided between the valve stopper and the orifice, which allows the valve plate to move away from the orifice. The integrally movable valve plate has higher pressure difference sensitivity and may fully open the orifice to facilitate fluid flow.

According to an aspect of the present disclosure, a groove is formed, around the orifice, on a bottom wall of the back pressure chamber, and the valve stopper is fixed on an inner circumferential wall of the groove. A gap is provided between the valve stopper and the inner circumferential wall of the groove. By providing the gap between the valve stopper and the inner circumferential wall of the groove, it is convenient for fluid to enter and exit the orifice through the gap.

According to an aspect of the present disclosure, the cover is a circular sheet and the valve stopper has a cylindrical shape to fit the groove formed in a substantially circular shape.

According to an aspect of the present disclosure, the valve stopper has a central through-hole penetrating through two end surfaces, and the central through-hole is substantially perpendicular to the cover. By providing the through-hole, a fluid pressure inside the back pressure chamber may act on the valve plate more directly and evenly, which makes the valve plate difficult to move laterally or tilt, and it is convenient for the valve plate to respond more sensitively to the pressure inside the back pressure chamber, so as to move longitudinally away from or close to the orifice.

According to an aspect of the present disclosure, a longitudinal notch is provided on the inner circumferential wall of the groove formed in a substantially circular shape, and the longitudinal notch forms the gap.

According to an aspect of the present disclosure, the back pressure chamber and the intermediate pressure chamber are in fluid communication via a breathing hole, and an inner diameter of the passage is larger than an inner diameter of the breathing hole.

According to an aspect of the present disclosure, a spring assembly is provided in the back pressure chamber, and an upper end of the spring assembly abuts against the floating sealing ring, and a lower end of the spring assembly abuts against a bottom wall of the back pressure chamber.

According to an aspect of the present disclosure, the spring assembly includes at least one supporting element that abuts against the floating sealing ring and at least one elastic element that is provided below the supporting element and abuts against the bottom wall of the back pressure chamber.

The arrangement of the spring assembly may further provide support for the floating sealing ring. Moreover, since an elastic support is provided, the axial flexibility of the expansion mechanism is not affected.

According to an aspect of the present disclosure, the supporting element is a ring-shaped sheet and the elastic element is a ring-shaped element with an uneven shape in the circumferential direction. The ring-shaped element with an uneven shape in the circumferential direction may provide a better stable bearing and has certain elastic deformation ability. In addition, it only needs to occupy a small space in the longitudinal direction, which is more suitable for a narrow internal space of the back pressure chamber.

In general, a scroll expander according to the present disclosure brings at least the following beneficial effects: the scroll expander according to the present disclosure may effectively prevent the scroll expander in the prior art from suffering from technical problems that failing to start or work normally due to insufficient initial pressure in the back pressure chamber. Moreover, the scroll expander of the present disclosure has a simple structure, is easy to be processed and manufactured, and has a higher cost-effectiveness.

BRIEF DESCRIPTION OF THE DRAWINGS

The foregoing and additional features and characteristics of the present disclosure will become more apparent from the following detailed description with reference to the accompanying drawings, which are merely examples and are not necessarily drawn to scale. The same reference numbers are used in the drawings to indicate the same components, and in the drawings.

REFERENCE MARK LIST

Figure 1:
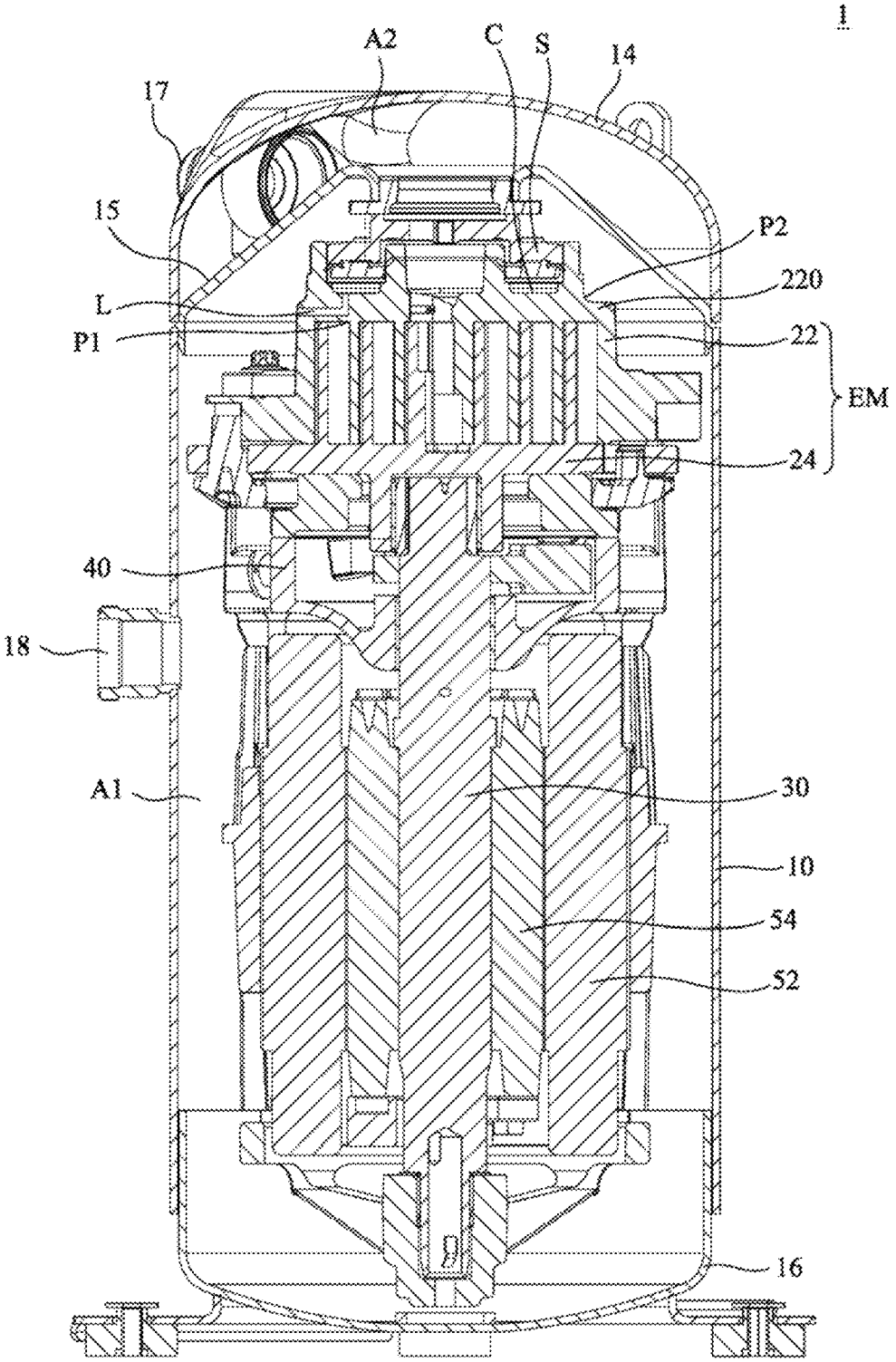
FIG. 1 shows a longitudinal cross-sectional view of a scroll expander according to a first preferred embodiment of the present disclosure, in which a passage leading from a back pressure chamber to the outside of an expansion mechanism is shown.

1: scroll expander
10: housing
14: top cover
16: bottom cover
15: partition plate
17: intake pipe
18: exhaust pipe
40: main bearing seat
30: rotating shaft
52: stator
54: rotor
EM: expansion mechanism
22: fixed scroll
24: orbiting scroll
220: end plate of the fixed scroll
11: external fluid circulation path
171: high-pressure fluid pipe
181: low-pressure fluid pipe
K1: high-pressure valve
100: bypass pipe
K2: bypass valve
P1: first side surface of the end plate of the fixed scroll
I: intake port
26: exhaust chamber
P2: second side surface of the end plate of the fixed scroll
C: back pressure chamber
S: floating sealing ring
28: intermediate pressure chamber
A1: low-pressure area
A2: high-pressure area
L: passage
V: check valve
L1: orifice of the passage
V1: cover
V10: screw hole of the cover
V2: screw
O: threaded hole
V3: valve stopper
V30: screw hole of the valve stopper
V31: side surface of the valve stopper
L10: groove
L102: inner circumferential wall of the groove
V32: central through-hole of the valve stopper
T: spring assembly
T1: supporting element
T2: elastic element

DETAILED DESCRIPTION OF THE EMBODIMENTS

The preferred embodiments of the present disclosure will be described in detail with reference to FIGS. 1-8*d*. The following description is merely exemplary in nature and is not intended to limit the present disclosure and the disclosure or use thereof. In each figures, corresponding elements or parts use the same reference marks.

In the following exemplary embodiments, the scroll expander is exemplarily shown as a vertical scroll expander with a floating fixed scroll. In some cases, the technical idea of providing a passage for fluid communication from a back pressure chamber to a low-pressure zone according to the present disclosure can also be applied to, for example, a case of a floating orbiting scroll expander in which the back pressure chamber is provided on one side of the orbiting scroll. Also, the scroll expander (hereinafter also referred to as "expander") according to the present disclosure may also be any other suitable types of scroll expanders such as a horizontal scroll expander.

The basic configuration and principle of the scroll expander 1 according to the present disclosure will be described below with reference to FIG. 1.

As shown in FIG. 1, a scroll expander 1 includes a substantially cylindrical housing 10, a top cover 14 provided at one end of the housing 10, and a bottom cover 16 provided at the other end of the housing 10. The housing 10, the top cover 14 and the bottom cover 16 constitute a casing of the scroll expander 1 with a closed space.

The scroll expander 1 further includes a partition plate 15 provided between the top cover 14 and the housing 10 for separating the inner space of the expander into a high-pressure area A2 (also referred to as high-pressure space) and a low-pressure area A1 (also referred to as low-pressure space). A high-pressure area A2 is defined between the partition plate 15 and the top cover 14, and a low-pressure area A1 is defined between the partition plate 15, the housing 10 and the bottom cover 16. An intake pipe 17 for introducing a high-pressure fluid (also referred to as working fluid) is provided in the high-pressure area, and an exhaust pipe 18 for discharging the expanded low-pressure fluid is provided in the low-pressure area A1.

The scroll expander 1 further includes an expansion mechanism EM composed of a fixed scroll 22 and an orbiting scroll 24. The orbiting scroll 24 is capable of rotating in translation relative to the fixed scroll 22 (i.e., the center axis of the orbiting scroll 24 revolves around the center axis of the fixed scroll 22, but the orbiting scroll 24 does not revolve around the central axis of the orbiting scroll 24). The translational rotation is achieved by, for example, an oldham coupling provided between the fixed scroll 22 and the orbiting scroll 24.

The fixed scroll 22 includes an end plate 220 of the fixed scroll, a static scroll wrap extending from a first side surface P1 of the end plate of the fixed scroll and an intake port I provided at the center of the end plate 220 of the fixed scroll for letting the high-pressure fluid enter into the expansion mechanism EM. The orbiting scroll 24 includes an end plate of the orbiting scroll and an orbiting scroll wrap extending from a side surface of the end plate of the orbiting scroll. The expansion mechanism EM defines the following various chambers: an exhaust chamber 26 in fluid communication with an exhaust port of the expansion mechanism EM (the exhaust chamber 26 is in direct fluid communication with the low-pressure area A1, and is collectively referred to as the low-pressure zone together with the low-pressure area A1), and an intake chamber in fluid communication with the intake port I, which is formed by the engagement of the static scroll wrap and the orbiting scroll wrap, and a series of closed expansion chambers for volumetric expansion of the working fluid. Specifically, in the series of expansion chambers, the radially innermost expansion chamber is adjacent to the intake port I and has substantially the same intake pressure as the introduced high-pressure fluid, so it is referred to as high-pressure chamber, the radially outermost expansion chamber has substantially the same exhaust pressure as the low-pressure fluid that will be discharged from the expansion mechanism EM, and thus it is referred to as low-pressure chamber. The expansion chamber between the high-pressure chamber and the low-pressure chamber has an intermediate pressure lower than the intake pressure and higher than the discharge pressure, and thus is referred to as intermediate pressure chamber 28. Wherein, a back pressure chamber C is provided on a second side surface (back side) P2 of the end plate 220 of the fixed scroll. The back pressure chamber C is sealed by a floating sealing ring S and is in fluid communication with the intermediate pressure chamber 28 through a breathing hole (not shown in the drawings).

The high-pressure fluid enters the high-pressure area A2 in the scroll expander 1 through the intake pipe 17, and then enters the expansion mechanism EM through the intake port I. The high-pressure fluid entering the expansion mechanism EM flows through the series of expansion chambers with gradually increasing volumes to be expanded and becomes a low-pressure fluid. The low-pressure fluid is discharged to the low-pressure area A1 outside the expansion mechanism EM, and then is discharged to the outside of the scroll expander 1 through the exhaust pipe 18 communicated with the scroll expander 1.

The scroll expander 1 further includes a main bearing seat 40. The main bearing seat 40 is fixed relative to the housing 10 by a suitable fastening method. The end plate of the orbiting scroll is supported by the main bearing seat 40.

The scroll expander 1 further includes a rotating shaft (may also be referred to as an output shaft) 30. The rotating shaft 30 is rotatably supported by a main bearing provided in the main bearing seat 40. An end of the rotating shaft 30 is coupled to a hub of the orbiting scroll 24 to be driven to rotate. When the scroll expander 1 is running, a driving torque is generated during a fluid expansion process performed by the expansion mechanism EM, which drives the rotating shaft 30 to rotate to output mechanical or electrical work.

The scroll expander 1 may further include a generator composed of a stator 52 and a rotor 54. The stator 52 is fixed to the housing 10. The rotor 54 is provided between the stator 52 and the rotating shaft 30. The rotor 54 is fixed to an outer circumferential surface of the rotating shaft 30 to rotate together with the rotating shaft 30 when the scroll expander 1 is operating, thereby enabling the generator to generate electricity.

Figure 2:
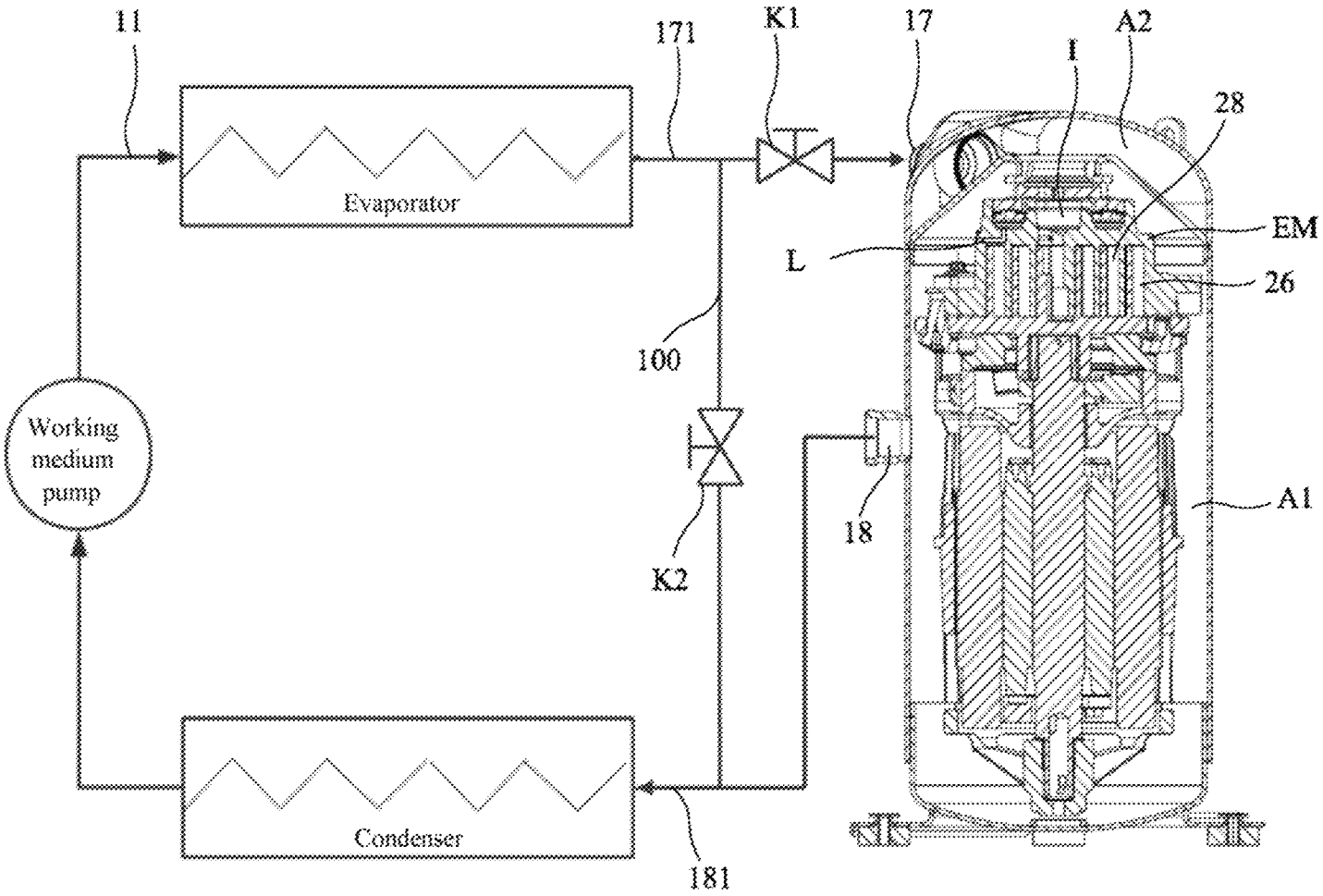
FIG. 2 shows a schematic fluid expansion circulation system including the scroll expander shown in FIG. 1.

In practical applications, a schematic fluid expansion circulation system shown in FIG. 2 (for example, an organic Rankine cycle system using a Carnot cycle) may include: the scroll expander 1 as described above; and an external fluid circulation path 11, wherein the external fluid circulation path 11 includes: a high-pressure fluid pipe 171 in fluid communication with an intake pipe 17 of the scroll expander 1, and the high-pressure fluid pipe 171 is configured to supply the intake pipe 17 with high-pressure fluid from an evaporator; a low-pressure fluid pipe 181 in fluid communication with the exhaust pipe 18 of the scroll expander 1, and the low-pressure fluid pipe 181 is configured to supply a condenser with low-pressure fluid exhausted from the scroll expander 1; and other pumping elements (such as a working medium pump as shown in the figure). A high-pressure valve K1 is provided on the high-pressure fluid pipe 171, and provided between the evaporator and the intake pipe 17. A bypass pipe 100 branched from the high-pressure fluid pipe 171 between the high-pressure valve K1 and the evaporator is in fluid communication with the low-pressure fluid pipe 181, and a bypass valve K2 is provided on the bypass pipe 100.

Generally, it is necessary to preheat various elements on the external fluid circulation path 11 (especially heat exchanger such as evaporator and condenser) before supplying the high-pressure fluid into the expansion mechanism EM. First, the high-pressure valve K1 is closed and the bypass valve K2 is opened to establish a fluid circulation circuit composed of the high-pressure fluid pipe 171, the bypass pipe 100, and the low-pressure fluid pipe 181, etc. At this time, a high-pressure side and a low-pressure side of the fluid circulation circuit are in fluid communication. Also, the low-pressure area A1 (and the exhaust chamber 26) in the housing 10 of the scroll expander 1 may still be in communication with the low-pressure fluid pipe 181, and thus a pressure in the low-pressure area A1 (and the exhaust chamber 26) is basically the same as a pressure of the high-pressure fluid that is about to enter into the expansion mechanism EM. Since the low-pressure area A1 is in fluid communication with the exhaust chamber 26 and therefore has the same fluid pressure, and hereinafter the low-pressure area A1 is taken as an example to describe stresses of the scroll expander in the prior art during a startup process.

Figure 3:
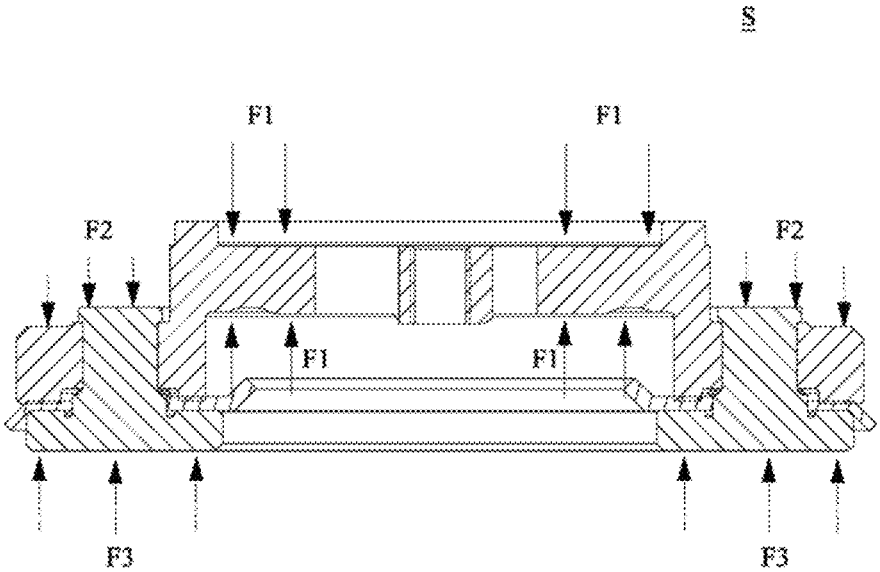
FIG. 3 shows a force diagram of a floating sealing ring in an expansion mechanism of a scroll expander in the prior art when the scroll expander is started.

In a scroll expander in the prior art, referring to FIG. 3, it can be seen that when the scroll expander is started to work, a floating sealing ring is under the following forces: at first, when the high-pressure valve K1 is opened and the bypass valve K2 is closed, and the high-pressure fluid is started to be input into the high-pressure area A2 in the scroll expander 1, a high-pressure stress (or intake stress) F1 and a low-pressure stress (or exhaust stress) F2 in the low-pressure area A1 (at this time, the low-pressure stress F2 are basically the same as the high-pressure stress F1) are acted on the floating sealing ring S at the same time (as shown in FIG. 3) and the forces are directed at urging the floating sealing ring S to collapse into the back pressure chamber C. Also, the pressure of the fluid entering into the back pressure chamber C through the intermediate pressure chamber 28 is dropped to an intermediate pressure F3 as the volume is expanded. It is obvious that F3<F1 and F3<F2. Therefore, it may be clearly seen from FIG. 3 that a resultant force F3+F1 that provides support to the floating sealing ring S is less than a resultant force F1+F2 that urge the floating sealing ring S to collapse into the back pressure chamber C. Therefore, since it is not capable of providing sufficient bearing force, the floating sealing ring S is unbalanced in force and therefore collapses into the back pressure chamber C and cannot play the role of sealing isolation. In particular, a top end of an upper plate of the floating sealing ring is moved away from, for example, a lower surface of the partition plate, so that the low-pressure area A1 and the high-pressure area A2 are directly connected, and the high-pressure fluid is then directly bypassed to the low-pressure area A1 through the high-pressure area A2 without entering into the expansion mechanism EM, and thus a normal pressure difference cannot be established in the scroll expander 1, and therefore the scroll expander 1 cannot start and work normally.

In view of the above technical problems, the present disclosure improves the scroll expander in the prior art. In general, the present disclosure improves the back pressure chamber C to be in fluid communication with the low-pressure zone when its pressure is insufficient, and to be isolated from the low-pressure zone when its pressure reaches a certain level, which can effectively solve the above problems, and normal start-up and operation of the scroll expander are achieved. Specifically, improved scroll expanders according to several preferred embodiments of the present disclosure are described in detail below with reference to FIGS. 4 to 8*d*.

Figure 4:
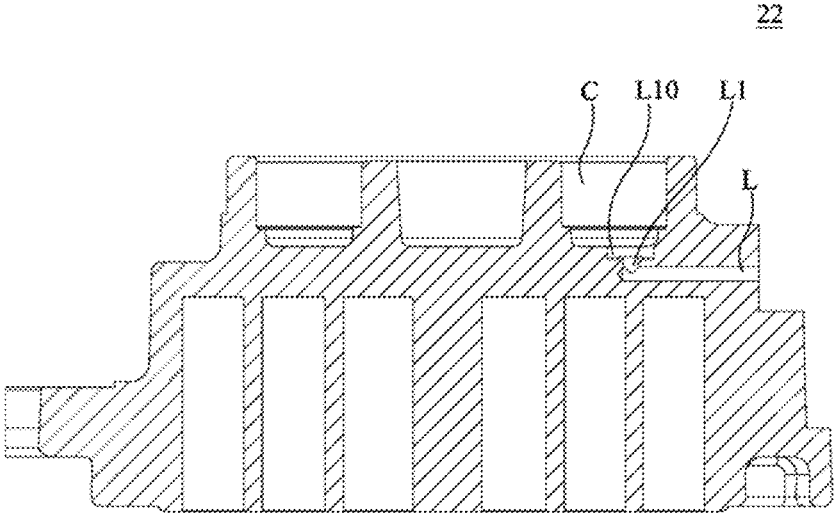
FIG. 4 shows a partial longitudinal cross-sectional view of the scroll expander in FIG. 1, in which a longitudinal cross-sectional view of a fixed scroll in the expansion mechanism is shown, and the passage directly leading to the outside of the expansion mechanism is shown.
Figure 5A:
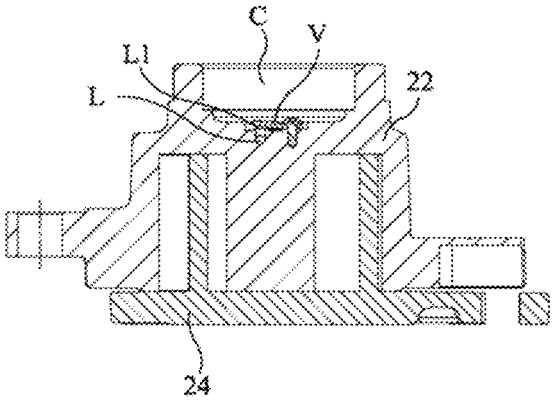
FIG. 5*a* shows a partial longitudinal cross-sectional view of the scroll expander in FIG. 1, in which a cross-sectional view of a part of a fixed scroll in the expansion mechanism is shown, and a cross-sectional view of a check valve provided in the back pressure chamber is shown.
Figure 5B:
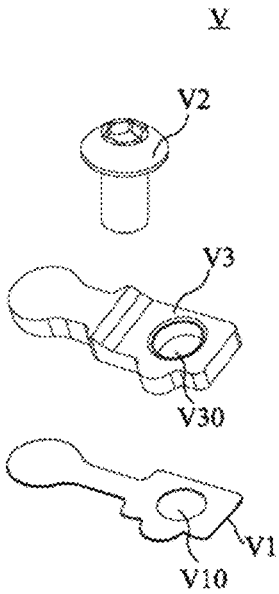
FIG. 5*b* shows an exploded perspective view of the check valve in FIG. 5*a;*
Figure 5C:
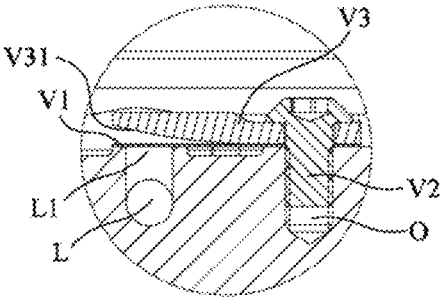
FIG. 5*c* shows an enlarged cross-sectional view of the check valve in FIG. 5*a*, in which the check valve in a state of closing an orifice of the passage is shown.
Figure 5D:
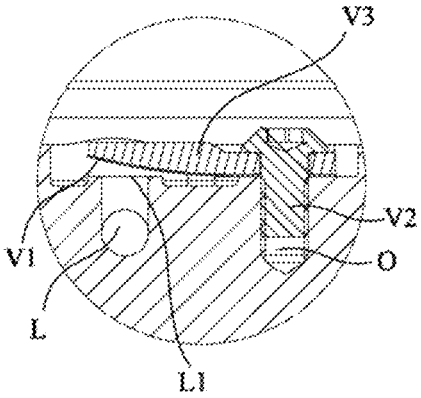
FIG. 5*d* shows an enlarged cross-sectional view of the check valve in FIG. 5*a*, in which the check valve in a state of opening an orifice of the passage is shown.

FIGS. 4 to 5*d* show partial views of the scroll expander in FIG. 1 according to the first preferred embodiment of the present disclosure. Reference is made to FIG. 4, which shows a longitudinal sectional view of the fixed scroll 220 in the expansion mechanism EM, and shows that the passage L in the fixed scroll 220 directly extends from the back pressure chamber C to the low-pressure area A1 outside the expansion mechanism EM (it may be seen from FIG. 1 and FIG. 2 that the expansion mechanism EM is in the low-pressure area A1). The passage L includes an orifice L1 that opens toward the back pressure chamber C, and a check valve V is provided near the orifice L1 to close and open the orifice L1. Preferably, in the present embodiment, a groove L10 is provided around the orifice L1 for accommodating the check valve V in the groove L10, so as to better protect the check valve V from external interference.

Referring to FIGS. 5*a* to 5*d*, an exemplary check valve V is shown. According to the present embodiment, the check valve V may include: a cover L1, wherein the cover L1 is shown as a long valve plate with a screw hole V10 at one end; and a screw V2, wherein the screw V2 passes through the screw hole V10 of the cover L1 and fits to a corresponding threaded hole O to fix the cover L1 so that the other end of the cover L1 covers the orifice L1, wherein the cover L1 is made of a material with elastic deformation property in the present embodiment, such as metal, high molecular polymers, etc., so that when a pressure in the back pressure chamber C is less than a pressure in the low-pressure area A1 in communication with the passage L, the cover L1 is elastically deformed and bends toward the back pressure chamber C, thereby opening the orifice L1.

According to the above configuration, in a preheating stage before starting the scroll expander 1 according to the present disclosure, a pressure in the back pressure chamber C is less than the low-pressure stress F2 in the low-pressure area A1 (at this time, the low-pressure stress F2 is substantially equal to the high-pressure fluid pressure). Therefore, under the dominant action of the low-pressure stress F2, the cover V1 of the check valve V elastically deforms to open the orifice L1, so that fluid in the low-pressure area A1 enters into the back pressure chamber C through the passage L, until the pressure in the back pressure chamber C is approximately equal to the low-pressure stress F2, so that the floating sealing ring S is maintained in a force-balanced state. When the high-pressure fluid is supplied to the expansion mechanism EM (the bypass valve K2 is closed at this time), the pressure of the high-pressure fluid is reduced after volume expansion (the high-pressure fluid reaches the back pressure chamber C through the intermediate pressure chamber 28 and then has the intermediate pressure stress F3, at this time F3<F2, F2=F1) and enters the back pressure chamber C so that the pressure in the back pressure chamber is less than the low-pressure stress F2 in the low-pressure area A1, and thus the cover V1 of the check valve V is elastically deformed to open the orifice L1. The fluid from the low-pressure area A1 enters the back pressure chamber C to provide pressure compensation to the back pressure chamber C so as to maintain a force balance of the floating sealing ring S (referring to FIG. 3, it should be pointed out that there may be a certain frictional force between a sealing part of the floating sealing ring and a wall that abuts against the sealing part. Although the frictional force is not shown in FIG. 3, it should be understood by those skilled in the art). The floating sealing ring S keeps sealing so as to isolate the high-pressure area A2 and the low-pressure area A1 in the housing 10 of the scroll expander 1. With the continuous expansion of high-pressure fluid, it becomes low-pressure fluid and is discharged into the low-pressure area A1, so that the low-pressure stress F2 in the low-pressure area A1 gradually drops to a stress equal to the exhaust pressure. Therefore, the force of the fluid in the low pressure area A1 acting on the floating sealing ring S gradually decreases and is less than the intermediate pressure stress F3 in the back pressure chamber C. When the intermediate pressure stress F3 in the back pressure chamber C is sufficient to maintain a force balance of the floating sealing ring S, the check valve V in the back pressure chamber C keeps the passage L closed. At this time, a stable intermediate pressure stress F3 is maintained in the back pressure chamber C, and a stable pressure difference is also established in the scroll expander 1 to ensure a normal operation of the scroll expander 1.

In the present embodiment, preferably, the check valve V further includes a valve stopper V3. The valve stopper V3 is a long sheet as shown in FIG. 5*b*. A first end of the valve stopper V3 has a screw hole V30 for a screw V2 to pass through and is fastened by the screw V2 to abut against the cover V1. That is, as shown in the figure, the cover V1 is provided between the orifice L1 and the valve stopper V3, and a second end of the valve stopper V3 is located above the orifice L1. In the present embodiment, a side surface V31 of the valve stopper V3, facing the cover V1, is formed as an arc surface, and the arc surface extends away from the orifice L1 as extending away from the first end, so that a certain gap is provided between the side surface V31 of the valve stopper V3 and the orifice L1, which allows the cover V1 to be elastically deformed under the action of pressure of the fluid from the orifice L1 to bend toward the back pressure chamber C, as shown in the figures, and thus the orifice L1 is opened (referring to FIG. 5*d*). Since the presence of the valve stopper V3, a degree of elastic deformation of the cover V1 is limited, so that the cover V1 may quickly recover to close the orifice L1 (referring to FIG. 5*c*), which makes the cover V1 more sensitive. In practical applications, the valve stopper V3 may have any possible shape, for example, the valve stopper V3 itself or its side surface V31 has a stepped shape or other shapes, as long as it may ensure that there is a certain space between the side surface V31 of the valve stopper V3 and the orifice L1.

In the above description, although it is shown that the cover V1 has a flat sheet shape so that it is elastically deformed only in a case of opening the orifice L1, it does not exclude cases that the cover V1 is elastically deformed only in a case of closing the orifice L1, and the cover V1 is elastically deformed in both cases of closing and opening the orifice L1. According to actual application requirements, not only materials with suitable elastic deformation resistance may be selected, but also the shape and/or orientation of the cover V1 may be set in advance, so that the cover V1 may be elastically deformed only in a case of closing the orifice L1 or in both cases of opening and closing the orifice L1. For example, referring to FIG. 5*b*, the cover V1 itself may have an arc shape, and is fixed to abut against the valve stopper V3 under normal conditions as shown in FIG. 5*b*. In this case, the cover V1 opens the orifice L1 without being elastic deformed. In a case that the cover V1 is forced to close the orifice L1 (as shown in FIG. 5*c*), the cover V1 is elastically deformed. For another example, on this basis, the curvature of the cover V1 is changed, so that it is in a middle position between the orifice L1 and the valve stopper V3 in a natural state and does not abut against either one. Obviously, the cover V1 is elastically deformed in both cases of closing and opening the orifice L1.

In addition, in the present embodiment, the check valve V is provided at the orifice L1 of the passage L, but in practical applications, the check valve may also be designed in the passage L or provided at the other orifice in the passage L which faces an outside opening of the expansion mechanism EM. In the case of being provided at the other orifice, only a change of position of the check valve V according to the present disclosure is involved, which is not described here. In the case of being provided in the passage L, the present embodiment may be achieved by using any suitable check valve in the prior art, for example, a flap-type valve that is elastically deformed, or an element similar to the check valve in a tire inflation hole. Even, it is also possible to consider the use of an electronic control valve, which is controlled by a controller for example to open and close according to the sensed related data or to open and close at a predetermined timing (for example, the electronic control valve is controlled to open when the expander is started and to close after a predetermined time).

In addition, in the present embodiment, the check valve V is shown to include a cover V1 and a valve stopper V3 fixed together by a screw V2 as described above, and the cover V1 is elastically deformed to open the orifice L1. However, in practical applications, the check valve V is not limited to the above structure. On the one hand, the cover V1 and the valve stopper V3 may be fixed in any other suitable ways, for example, snap joint, hinge joint, riveting, welding, and adhesion, etc. In addition, the cover V1 and the valve stopper V3 may be fixed in different ways and different positions, or only the valve stopper V3 is fixed, and the cover V1 is a movable element that is completely limited in position and movement range by the valve stopper V3. On the other hand, the cover V1 itself may also be made of non-elastically deformable materials. For example, the cover V1 may be in a blade form fixed by hinge joint, etc., which is pivotally openable, and the valve stopper V3 is fixed to limit an opening size of the cover V1 pivotally opened. Furthermore, the valve stopper V3 may be made of a material that can be elastically deformed to a certain extent so as to restrict the opening size of the cover V1 pivotally opened through the elastic deformation in a certain degree.

Figure 6A:
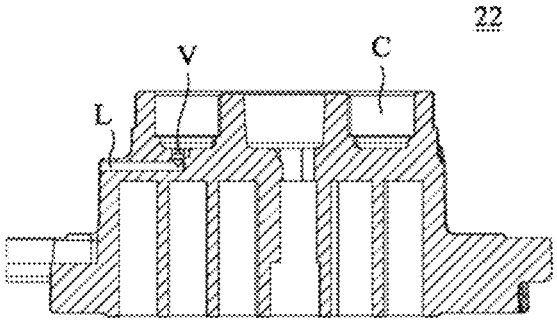
FIG. 6*a* shows a longitudinal cross-sectional view of a fixed scroll of the scroll expander according to a second preferred embodiment of the present disclosure, in which a cross-sectional view of a check valve provided in the back pressure chamber is shown.
Figure 6B:
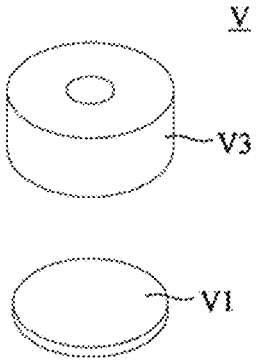
FIG. 6*b* shows an exploded perspective view of the check valve in FIG. 6*a;*
Figure 6C:
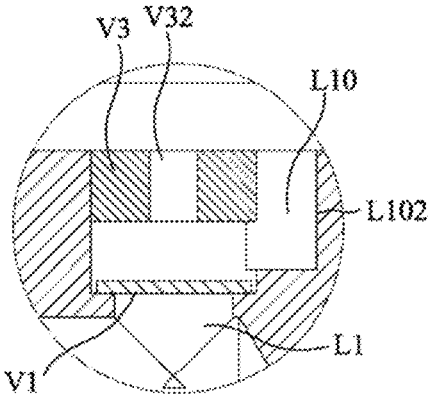
FIG. 6*c* shows an enlarged cross-sectional view of the check valve in FIG. 6*a*, in which the check valve in a state of closing an orifice of the passage is shown.
Figure 6D:
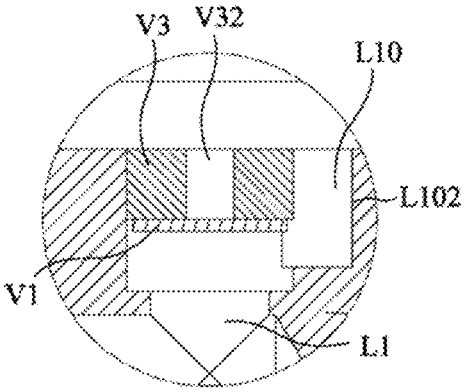
FIG. 6*d* shows an enlarged cross-sectional view of the check valve in FIG. 6*a*, in which the check valve in a state of opening an orifice of the passage is shown.

FIGS. 6*a* to 6*d* show the second embodiment according to the present disclosure. Referring to FIG. 6*b*, in the present embodiment, the passage L has the same configuration as the first embodiment, and the check valve V is also provided at the orifice L1. The check valve V includes a cover V1 and a valve stopper V3. Exemplarily, in FIGS. 6*a* to 6*d*, the cover V1 is shown as a circular valve plate, the valve stopper V3 is shown as a cylindrical element, and the valve stopper V3, at its center, has a central through-hole V32 that penetrates two circular end faces. Referring to FIGS. 6*c* and 6*d*, it may be seen that the cover V1 is placed in the groove L10 on the outer circumference of the orifice L1 and covers the orifice L1. The valve stopper V3 is fixed at a position above the orifice L1 in a predetermined spaced location to allow the cover V1 reciprocate between the orifice L1 and the valve stopper V3, and the central through-hole V32 of the valve stopper V3 is perpendicular to the cover V1, so that the fluid pressure in the back pressure chamber C may be uniformly applied to the cover V1. As mentioned above, the valve stopper V3 in the present embodiment may also be fixed to the back pressure chamber C in various suitable ways. In the present embodiment, the valve stopper V3 is preferably fitted in the groove L10 by an interference snap fit. Also, as shown in the figure, there is a gap between one side of the valve stopper V3 and an inner peripheral wall L102 of the groove L10, wherein the gap may be formed by expanding a part of the groove L10 radially outward. The gap is to facilitate fluid communication between the back pressure chamber C and an external pressure zone in a case that the orifice L1 is opened.

In a case that a pressure in the back pressure chamber C is less than a pressure in the low-pressure area A1, the cover V1 is pushed up to the valve stopper V3, the orifice L1 is opened (referring to FIG. 6*d*), so that the back pressure chamber C is communicated with the low-pressure area A1 communicated with the orifice L1 through the gap. In a case that the pressure in the back pressure chamber C is greater than or equal to the pressure of the low-pressure area A1, the cover V1 is pressed to be abut against the orifice L1, thereby closing the orifice L1.

Figure 7:
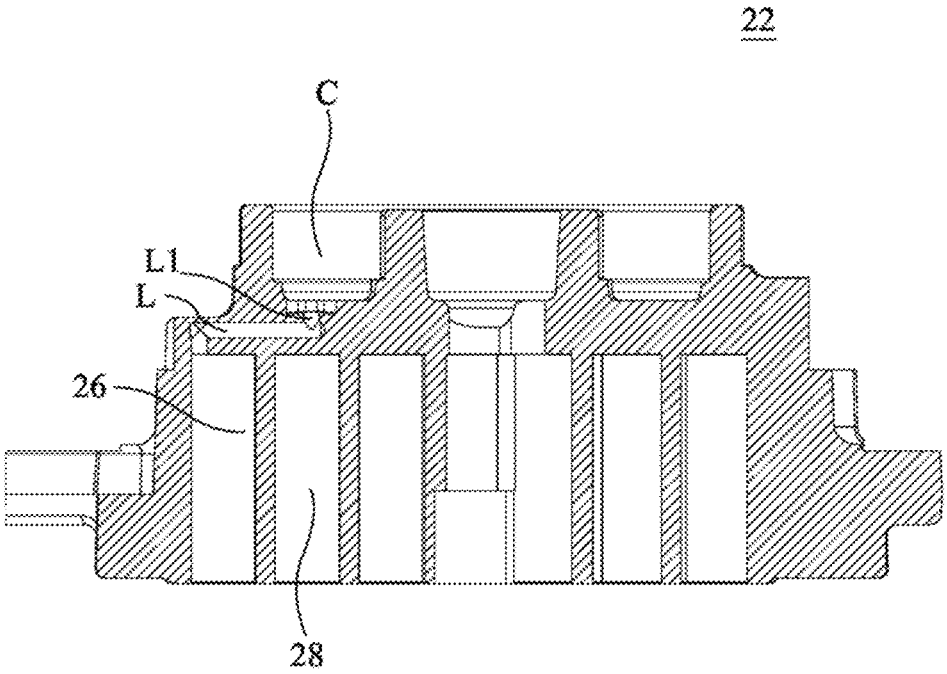
FIG. 7 shows a longitudinal cross-sectional view of a fixed scroll of the scroll expander according to another embodiment of the present disclosure, in which the passage is shown communicating from the back pressure chamber to the exhaust chamber.

Although the passage L in the above preferred embodiments is in direct communication from the back pressure chamber C to the low-pressure area A1 outside the expansion mechanism EM, the present disclosure is not limited to this. For example, as shown in FIG. 7, the passage L may also be communicated from the back pressure chamber C to the exhaust chamber 26 in the expansion mechanism EM. As described above, the exhaust chamber 26 is in fluid communication with the exhaust port of the expansion mechanism EM, so as to be in fluid communication with the low-pressure area A1. Therefore, the passage L with this configuration may also be used to achieve the technical object of the present disclosure.

On the other hand, as mentioned above, the back pressure chamber C is in fluid communication with the intermediate pressure chamber 28 through the breathing hole (not shown in the drawings). Therefore, when the scroll expander is started, in a case that a pressure in the back pressure chamber C is greater than a pressure in the intermediate pressure chamber 28, fluid in the back pressure chamber C flows into the intermediate pressure chamber 28 through the breathing hole, so that a fluid pressure in the back pressure chamber C drops to a pressure below the pressure in the low-pressure zone (the low-pressure area A1 and the exhaust chamber 26). Therefore, in order to increase the pressure in the back pressure chamber C as soon as possible and better keep the pressure in the back pressure chamber C the same as the low-pressure zone, an inner diameter of the passage L may be made larger than an inner diameter of the breathing hole. In particular, the passage L may be provided so that the diameters of each cross-sections of the passage L are significantly larger than the diameter of the breathing hole, so as to ensure that the amount of fluid entering into the back pressure chamber C through the passage L is much greater than the amount of fluid flowing into the intermediate pressure chamber 28 from the back pressure chamber C through the breathing hole.

The above preferred embodiments are all involved with the passage L and the check valve V. However, the present disclosure may also adopt other different elements to provide support for the floating sealing ring S to ensure a normal startup and operation of the scroll expander 1. For example, FIGS. 8*a* to 8*d* show the third preferred embodiment according to the present disclosure.

Figure 8A:
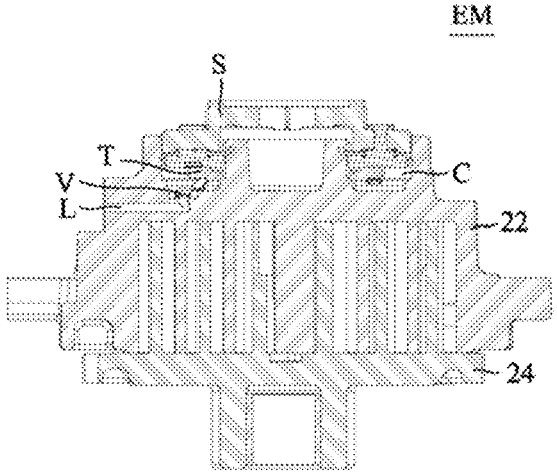
FIG. 8*a* shows a longitudinal cross-sectional view of an expansion mechanism of the scroll expander according to a third preferred embodiment of the present disclosure, in which a cross-section of a spring assembly provided in the back pressure chamber is shown.
Figure 8B:
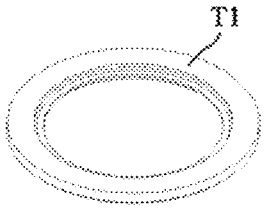
FIG. 8*b* shows a perspective view of a supporting element in the spring assembly in FIG. 8*a;*
Figure 8C:
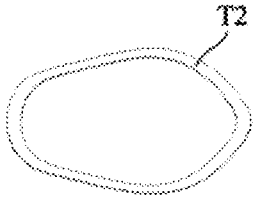
FIG. 8*c* shows a perspective view of an elastic element in the spring assembly in FIG. 8*a*.
Figure 8D:
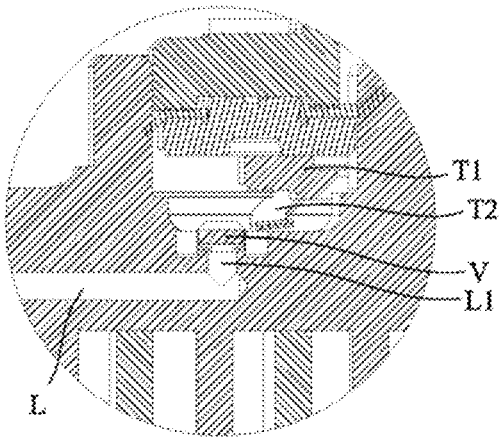
FIG. 8*d* shows a partial cross-sectional view of the expansion mechanism in FIG. 8*a*, in which an enlarged cross-sectional view of the spring assembly is shown.

According to the third preferred embodiment, on the basis of the first and second preferred embodiments, a spring assembly T is added. As shown in the figures, the spring assembly T includes a supporting element T1 (FIG. 8*b*) and an elastic element T2 (FIG. 8*c*), wherein the supporting element T1 abuts against and supports the floating sealing ring S, and the elastic element T2 is provided under the supporting element T1 and abuts against the bottom wall of the back pressure chamber C, so as to provide elastic support for the supporting element T1 and the floating sealing ring S. According to the present disclosure, the supporting element T1 may be any suitable element with a stable bearing capacity, and the elastic element T2 may be any suitable element with an elastic deformation capacity, such as a coil spring, a leaf spring, a disc spring, etc. In the present embodiment, preferably, the supporting element T1 is shown as a ring-shaped sheet, and the elastic element T2 is shown as a ring-shaped element having an uneven shape, preferably a wave shape, in the circumferential direction. And preferably, as shown in FIG. 8*d*, the supporting element T1 has a certain thickness, and the elastic element T2 may be formed by stacking and combining multiple of the above ring-shaped elements with the irregular shape. For example, as shown in the figures, the elastic element T2 is formed by stacking and combining two of the above ring-shaped elements with the irregular shape.

Those skilled in the art should understand that the spring assembly T of the above configuration is only an exemplary embodiment, and it may also be an integral part, and may have any suitable configuration. By providing such a spring assembly T, it is possible to further provide support for the floating sealing ring S to ensure the normal startup and operation of the scroll expander 1. In addition, although the passage L, the check valve V, and the spring assembly T are all adopted in the scroll expander of the third embodiment described above, it should be understood that, in a case that the spring assembly T may provide sufficient supporting force to the floating sealing ring S, the passage L and the check valve V may not be provided at all, and only the spring assembly T is adopted.

Although the passage, the orifice of the passage, the check valve and its cover and valve stopper, the spring assembly and its supporting element and elastic element in the above preferred embodiment are all shown as a specific number, it should be understood that any number of the above elements may be set respectively.

Although the exemplary embodiments of the scroll expander according to the present disclosure are described in the above embodiments, the present disclosure is not limited thereto, but various modifications, replacements and combinations can be performed without departing from the spirit and protection scope of the present disclosure.

Obviously, various implementations can be further designed by combining or modifying different embodiments and each technical feature in different ways.

The scroll expanders according to the preferred embodiments of the present disclosure are described above in conjunction with the specific implementations. It can be understood that, the above description is merely exemplary rather than restrictive, and those skilled in the art can conceive various variations and modifications without departing from the scope of the present disclosure with reference to the above description. These variations and modifications shall still fall in the protection scope of the present disclosure.

What is claimed is:

1. A scroll expander, comprising:

a housing; and an expansion mechanism provided inside the housing and configured to expand a high-pressure fluid with an intake pressure to a low-pressure fluid with an exhaust pressure, the expansion mechanism comprising a fixed scroll and an orbiting scroll and defining therein an exhaust chamber, an intake chamber and a series of closed expansion chambers, wherein a back pressure chamber is provided on the expansion mechanism, and the back pressure chamber is in fluid communication with an intermediate pressure chamber of the series of expansion chambers which has an intermediate pressure lower than the intake pressure and higher than the exhaust pressure, wherein at least one passage in fluid communication from the back pressure chamber to a low-pressure zone with the exhaust pressure is provided, and the passage is configured such that the passage is opened when a pressure in the back pressure chamber is less than a pressure in the low-pressure zone and the passage is closed when a pressure in the back pressure chamber is greater than or equal to a pressure in the low-pressure zone.

2. The scroll expander according to claim 1, wherein the fixed scroll is capable of floating axially relative to the orbiting scroll.

3. The scroll expander according to claim 2, wherein the back pressure chamber is provided at a back side of an end plate of the fixed scroll, and the back pressure chamber is sealed by a floating sealing ring.

4. The scroll expander according to claim 3, wherein the low-pressure zone comprises a low-pressure area outside the expansion mechanism and the exhaust chamber of the expansion mechanism which is directly communicated with the low-pressure area, and the passage is provided in the end plate of the fixed scroll and is directly communicated with the low-pressure area or directly communicated with the exhaust chamber.

5. The scroll expander according to claim 1, wherein a check valve capable of closing and opening the passage is provided at the passage such that the passage is opened when a pressure in the back pressure chamber is less than a pressure in the low-pressure zone and the passage is closed when a pressure in the back pressure chamber is greater than or equal to a pressure in the low-pressure zone.

6. The scroll expander according to claim 5, wherein the passage comprises an orifice that opens into the back pressure chamber, and the check valve is provided at the orifice to close and open the orifice.

7. The scroll expander according to claim 6, wherein the check valve comprises a valve plate and a valve stopper provided at the orifice, and the valve plate is provided as an elastically deformable valve plate fixed at one end or as an integrally movable valve plate, and the valve stopper is provided so that the valve plate is disposed between the orifice and the valve stopper.

8. The scroll expander according to claim 1, wherein the back pressure chamber and the intermediate pressure chamber are in fluid communication through a breathing hole, and an inner diameter of the passage is larger than an inner diameter of the breathing hole.

9. The scroll expander according to claim 2, wherein the back pressure chamber and the intermediate pressure chamber are in fluid communication through a breathing hole, and an inner diameter of the passage is larger than an inner diameter of the breathing hole.

10. The scroll expander according to claim 3, wherein the back pressure chamber and the intermediate pressure chamber are in fluid communication through a breathing hole, and an inner diameter of the passage is larger than an inner diameter of the breathing hole.

11. The scroll expander according to claim 4, wherein the back pressure chamber and the intermediate pressure chamber are in fluid communication through a breathing hole, and an inner diameter of the passage is larger than an inner diameter of the breathing hole.

12. The scroll expander according to claim 5, wherein the back pressure chamber and the intermediate pressure chamber are in fluid communication through a breathing hole, and an inner diameter of the passage is larger than an inner diameter of the breathing hole.

13. The scroll expander according to claim 6, wherein the back pressure chamber and the intermediate pressure chamber are in fluid communication through a breathing hole, and an inner diameter of the passage is larger than an inner diameter of the breathing hole.

14. The scroll expander according to claim 7, wherein the back pressure chamber and the intermediate pressure chamber are in fluid communication through a breathing hole, and an inner diameter of the passage is larger than an inner diameter of the breathing hole.

15. The scroll expander according to claim 3, wherein a spring assembly is provided in the back pressure chamber, and an upper end of the spring assembly abuts against the floating sealing ring, and a lower end of the spring assembly abuts against a bottom wall of the back pressure chamber.

16. The scroll expander according to claim 4, wherein a spring assembly is provided in the back pressure chamber, and an upper end of the spring assembly abuts against the floating sealing ring, and a lower end of the spring assembly abuts against a bottom wall of the back pressure chamber.

17. The scroll expander according to claim 15, wherein the spring assembly comprises at least one supporting element that abuts against the floating sealing ring and at least one elastic element that is provided below the supporting element and abuts against the bottom wall of the back pressure chamber.

18. The scroll expander according to claim 17, wherein the supporting element is a ring-shaped sheet and the elastic element is a ring-shaped element with an uneven shape in the circumferential direction.

* * * * *